US009315360B2

(12) United States Patent
Van Der Paal

(10) Patent No.: US 9,315,360 B2
(45) Date of Patent: Apr. 19, 2016

(54) MOTORIZED HOSE REEL

(75) Inventor: Peter Van Der Paal, Sint-Gillis-Waas (BE)

(73) Assignee: ALPHA REEL BVBA, Sint-Gillis-Waas (BE)

( * ) Notice: Subject to any disclaimer, the term of this patent is extended or adjusted under 35 U.S.C. 154(b) by 177 days.

(21) Appl. No.: 13/821,275

(22) PCT Filed: Sep. 8, 2011

(86) PCT No.: PCT/IB2011/053930

§ 371 (c)(1), (2), (4) Date: Mar. 7, 2013

(87) PCT Pub. No.: WO2012/032486

PCT Pub. Date: Mar. 15, 2012

(65) Prior Publication Data

US 2013/0161438 A1 Jun. 27, 2013

(30) Foreign Application Priority Data

Sep. 8, 2010 (BE) ..... 2010/0536

(51) Int. Cl.

*A62C 35/00* (2006.01)
*B65H 75/34* (2006.01)
*B65H 75/00* (2006.01)
(Continued)

(52) U.S. Cl.

CPC ..... *B65H 75/4486* (2013.01); *B65H 75/44* (2013.01); *B65H 75/4402* (2013.01); *B65H 75/4426* (2013.01); *B65H 75/4484* (2013.01); *B65H 2701/33* (2013.01)

(58) Field of Classification Search

CPC ..... B65H 75/44; B65H 75/4402
USPC ..... 137/355.16, 355.2, 355.21, 355.22, 137/355.26; 242/390.8; 239/195–198
See application file for complete search history.

(56) References Cited

U.S. PATENT DOCUMENTS 2,514,862 A * 7/1950 Hannay ..... 137/355.2
2,962,227 A 12/1960 Lambert
(Continued)

FOREIGN PATENT DOCUMENTS

FR 2221395 10/1974
WO 2004080161 9/2004
(Continued)

OTHER PUBLICATIONS

International Search Report for PCT/IB2011/053930, Completed by the European Patent Office on Dec. 15, 2011, 4 Pages.

*Primary Examiner* — John K Fristoe, Jr.
*Assistant Examiner* — Kelsey Rohman
(74) *Attorney, Agent, or Firm* — Brooks Kushman P.C.

(57) ABSTRACT

Hose reel with a drum, driven in an appropriate manner by a motor, and provided with a hose through which a medium can flow, which hose is connected to a tool at one far end provided with a control to operate this tool, i.e. to start and to stop it, and whose other far end is, either directly or indirectly, connected to a supply line, characterized in that the hose reel includes a detection module, which has a detection body, a signal sensor and a processing unit. The detection body can detect every flow and/or interruption of the flow of a medium resulting from the operation of the control, and generate an electrical pulse or pulses with a signal sensor, which are interpreted by the processing unit on the basis of a pulse scheme to control operation of the motor.

7 Claims, 7 Drawing Sheets

Figure 1:
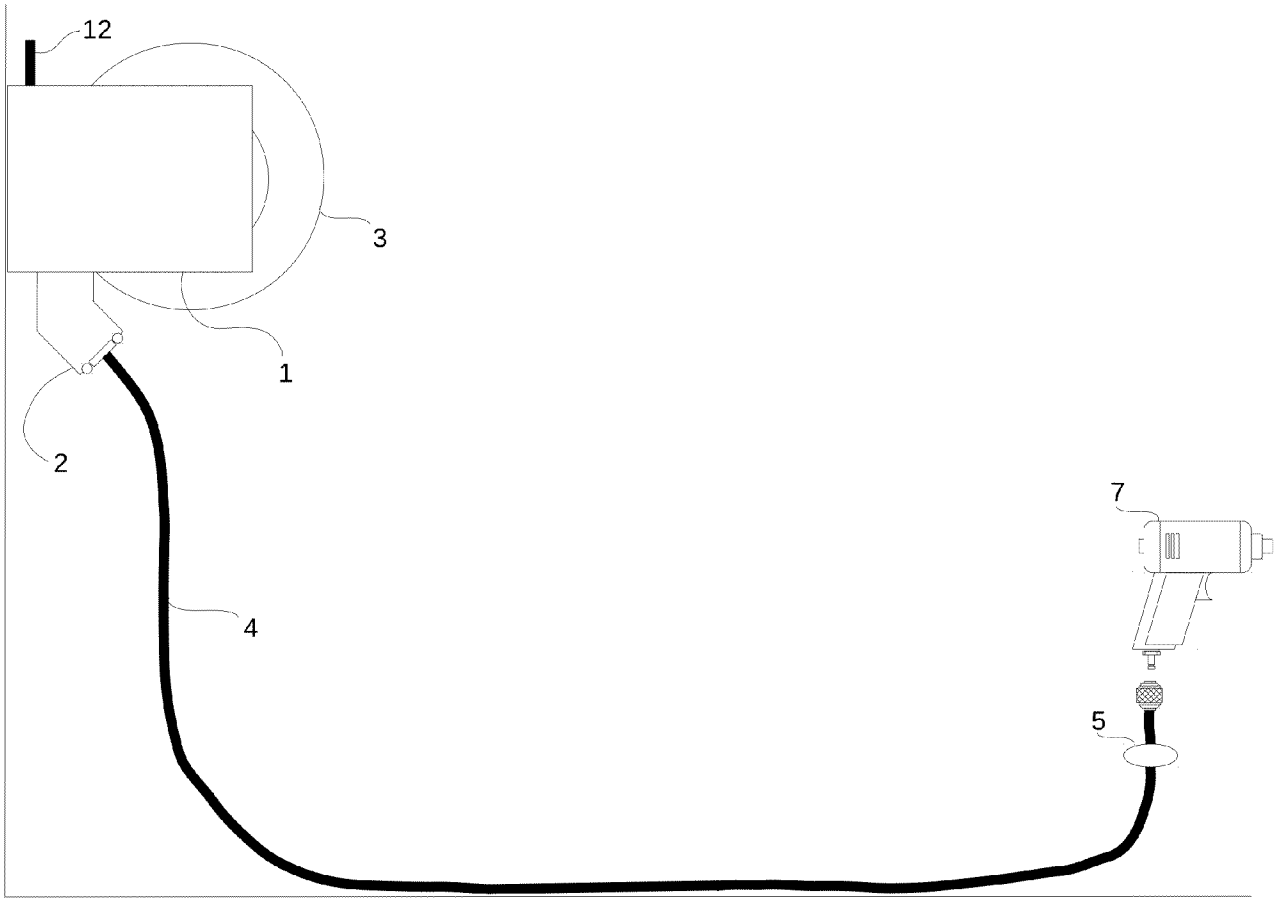

(51) Int. Cl.
*B65H 75/48* (2006.01)
*B65H 75/44* (2006.01)

(56) References Cited

U.S. PATENT DOCUMENTS 4,305,553 A * 12/1981 Coquerel ..... 137/355.25
4,311,165 A * 1/1982 Rose, Jr. ..... 137/355.12
5,495,995 A * 3/1996 Dominique et al. ..... 242/390.1
5,784,232 A * 7/1998 Farr ..... 361/22
5,947,148 A 9/1999 DeVito
6,178,992 B1 * 1/2001 Van Der Paal ..... 137/355.2
6,978,960 B2 * 12/2005 Schaller ..... 242/385.3
7,503,338 B2 3/2009 Harrington et al.
2008/0223951 A1 9/2008 Tracey et al.
2010/0006685 A1 1/2010 Crucs et al.

FOREIGN PATENT DOCUMENTS

WO 2004103875 12/2004
WO 2008103941 8/2008

* cited by examiner

MOTORIZED HOSE REEL

CROSS-REFERENCE TO RELATED APPLICATION

This application is the U.S. national phase of PCT Appln. No. PCT/IB2011/053930 filed on Sep. 8, 2011, which claims priority to BE Patent Application No. BE 2010/0536 filed on Sep. 8, 2010, the disclosures of which are incorporated in their entirety by reference herein.

The present invention concerns a motorized hose reel for conveying gases or liquids, whereby the winding of the hose can be activated or deactivated from a distance by the user without using any additional control organs.

Reels are often used to conveniently store hoses in a tidy manner.

Conventional hose reels are equipped with a spring motor. When the user extends the hose, a spring is simultaneously tightened. This makes sure that the hose is coiled up again after its use. Although widely used, this method has a number of major disadvantages, especially as far as safety and ergonomics are concerned.

A major disadvantage of spring-driven hose reels is that the force of the spring increases proportionally as the user unwinds more hose. Depending on the length and diameter of the hose, this force may increase to 300 Nf. In other words, this solution requires a lot of effort from the user, and it is therefore not suitable for intensive applications such as for example in car assembly plants.

A second disadvantage of spring-driven hose reels is that a highly dangerous situation is created if the hose is accidentally released while being unwound. Indeed, the tightened spring will withdraw the hose at high speed. This uncontrolled situation will not only cause damage to the reel, but can also cause physical injury to the user and/or bystanding colleagues.

A third disadvantage of spring-driven hose reels concerns the locking mechanism. This mechanism must prevent the hose from being continuously retracted by the spring while in use. After having unwound the required length, the user must find the nearest locking position before he can release the hose. In practice, finding this locking position is often found to be a frustrating and time-consuming experience. In addition, when the user has finished and the hose should be wound back, he must disable this locking mechanism first. Especially for long and/or heavy hoses, this requires much effort from the user. Finally, it should be noted that this locking mechanism comprises a pawl and a spring and that both components are subject to wear. As mentioned above, this may again lead to dangerous situations, should one or both components fail.

PRESENT STATE OF THE ART

In order to remedy the disadvantages of spring-driven hose reels, solutions whereby a driving motor is used for winding the hose are increasingly being sought for. With this type of hose reel, however, a specific problem arises, i.e. how should the user generate the starting signal for winding the hose in a fast, easy and secure way?

In most motorized hose reels, the mechanical or electrical controls are usually provided on or next to the reel. This means that the user must first walk back to the reel so as to operate some start button which activates the driving motor of the reel. While walking back, he must drag the hose behind him. Also, this working method requires additional efforts from the user.

A second major disadvantage of this method is that the user, while walking to the reel, must take care not to trip over the hose. Since the hose will not be wound until the user has reached the reel, the latter has to watch where he puts his feet so as not to step on the hose or end up with his foot in the loop of the hose.

Finally, with this working method whereby the winding cannot start until the user has reached the reel again, he will have to wait until the entire hose has been wound again, which implies an unnecessary waste of time.

Other motorized hose reels (U.S. Pat. No. 5,495,995) make use of a friction clutch and a sensor which detects every movement of the drum. When the user's task is finished, he has to pull the hose. This movement is detected by the sensor and converted into a winding signal which in turn activates the driving motor. The driving motor always turns in the winding direction. In order to make the driving motor stop, the user must hold the hose and wait a few seconds, such that the sensor no longer detects any movement of the drum.

One of the disadvantages of this method is that the driving motor will always strike as soon as the drum moves, even if it is not desirable. This is the case, for example, while manually unwinding the hose or when the user, while performing his task, pulls the hose because he needs more hose. In both cases, the driving motor will strike and the user must hold the winding hose and wait a few seconds until the driving motor stalls. In practice, pulling the hose unnecessarily hard and needlessly waiting for the drive to cut out is found to be very annoying.

Another disadvantage of this method is the wear of the friction clutch. As mentioned, the driving motor in this solution always turns in the winding direction, even when the user unwinds the hose. A friction clutch is provided between the driving motor and the drum to make this possible. A disadvantage of this method is that the friction material wears and that the clutch must be very often adjusted. The proper adjustment of this type of clutches takes a lot of time and experience. An additional problem is that the friction clutch is not easily accessible.

Another disadvantage of this working method is that, when the user's task is finished, he must first lift the hose and stretch it tightly to get the drum moving from a distance, so that the sensor can capture this movement and start the winding. This operation requires additional efforts from the user and is very labour-intensive, especially in the case of long and/or heavy hoses.

Another disadvantage inherent to this method is the "bouncing loop". With this working method there is a constant switching of forces between the upward force exerted by the driving motor on the one hand, and the downward force caused by the weight of the hose and the friction when dragging the hose over the shop floor on the other hand. As long as the upward force of the driving motor is larger, the friction clutch will engage and turn the drum in the winding direction. As soon as the opposing force of the hose takes over, however, the friction clutch will slip, making the drum start to turn in the unwinding direction. The result is that the drum continuously rotates in one, then again in the other direction. As the sensor sees the drum moving constantly, the driving motor will keep on running and the hose will keep bouncing up and down.

Finally, as an additional disadvantage of this method is mentioned that the winding speed of the hose is not adjustable with this type of motorized hose reels. This means that the user must adapt his walking pace (work speed) to the speed of the hose reel, which is not desirable in many workplaces.

Yet other motorized hose reels use a wireless remote control to generate the winding signal (WO2008103941). As soon as the user's task is finished, he has to operate a transmitter button. The latter emits a high-frequency signal which is picked up by a receiver and then converted into an electrical signal. The latter in turn makes the motor drive the hose reel. In practice, this working method has many disadvantages.

Any method which uses an additional control is impracticable in many work situations since two hands are required: one to carry the tool and one to operate the additional control. In many cases (among others car assembly), apart from the tool, the user also has to carry parts or other tools, leaving him with no hands free to operate any additional controls. Since the wireless solutions use an additional control (transmitter), this also applies here.

Another disadvantage of wireless systems is that this method requires an additional operation from the user, i.e. finding and operating the transmitter. In many work situations (among others car assembly), this extra operation is highly undesirable.

In some working environments, wireless remote control may not be used because of the danger of interference with other machines and processes. This is particularly the case in car assembly plants, where there are a lot of electronics.

The electronics of wireless remote controls are very vulnerable and therefore do not guarantee any operational reliability, especially not in the long term. However, in many work situations (among others car assembly) operational reliability is extremely important. The problem is even more true for wireless systems in which the transmitter is mounted on the far end of the hose (WO2004080161). The electronics will be damaged in no time by roughly laying down (i.e. throwing down) the connected tool.

In order to exclude the problem of vulnerability, a portable transmitter is suggested (idem). This method is very awkward in many work situations. The user first has to look for the transmitter and then for the right button. Moreover, the probability that the transmitter sooner or later drops out of his hands is very high, all the more when one considers that the user wears gloves in many work situations. The vulnerability of the electronics is by no means remedied with a portable transmitter.

In practice, a portable transmitter is not only awkward, it is also very laborious. In many work situations, the user must be able to operate different hose reels. Since every hose reel requires its own transmitter, the user must first find out which transmitter goes with which hose reel. In many work situations, this is far too laborious.

In practice, a portable transmitter is not only very awkward and laborious, but in situations where several users have to operate one and the same hose reel, the solution is simply useless. In addition, in work situations where people work in shifts, each user must take great care to hand his transmitter(s) to his colleague from the next shift. This goes wrong in practice.

Another major disadvantage of wireless systems is that the transmitter must always be fed, usually by (lithium) batteries because of its light weight. Especially in case of intensive use they must be regularly replaced. This is a time-consuming operation. Moreover, such an operation is impossible during production. To ensure continuity of production, a regular monitoring system should be implemented in view of a precautionary replacement of all batteries, whether they are low or not. Since not all hose reels are used with an equivalent intensity, chances are that some batteries should not even have to be replaced yet. Not only the cost of (lithium) batteries, but especially the labour costs for performing such a periodic maintenance and the accompanying administration make wireless systems extremely expensive.

Another way to generate a winding signal from a distance is by making use of what is called a "hose-in-hose" system (U.S. Pat. No. 2,963,227). According to this method, a second hose is situated in a cavity of the hose which allows communication between the user and the winding system. The second "control line" hose is filled with a liquid, usually oil because of its low compressibility. By compressing this liquid at the far end of the hose, a switch valve at the starting point of the hose is operated. In this way, the user can generate a signal from a distance which is used to activate the drive of the hose reel. This solution has many disadvantages as well.

A problem which is inherent to hose-in-hose systems regards the vulnerable connections which are required to keep both products entirely separated. Indeed, the control line must enter and subsequently leave the main hose in a flexible but reliable manner. Since this is a dynamic application, chances are that leaks will occur sooner or later whereby the content of the control line is mixed with the content of the main hose. Such a contamination cannot be visually detected. This may lead to very dangerous situations, for example when refueling aircrafts or when putting out fires.

Another problem which is inherent to hose-in-hose systems is the varying length of the control line, also called the "stretch effect". When the main hose has been entirely unwound, the control line should have the same length as the main hose. However, if the main hose is wound on a drum, the control line will stretch against the underside of the main hose and thus will have a smaller coiling diameter. As a result, less control line than main hose will be wound, such that the control line is longer than the main line in the end! This effect is particularly dangerous for leaks at the connection between the control line and the control at the far end of the hose.

Another problem which is inherent to hose-in-hose systems is that the control line claims part of the available space in the main hose. Moreover, the control line must have a thick wall so as not to expand when the pressure in the control line is raised. In other words, this method is always at the expense of the flow rate and that is why it is never used in work situations where the flow rate is of major importance or where the medium should be conveyed as fast as possible. The latter is certainly so in case of fire fighting, but also when unloading fuels, chemicals, etc.

Another problem which is inherent to hose-in-hose systems is that this method can only work by providing an additional control ("signal-generating means") at the far end of the hose. This solution is not only expensive, but also heavy. Apart from the weight of the hose and the weight of the control (e.g. a nozzle), the user is forced to drag the extra weight of the "signal-generating means" behind him as well.

A final disadvantage of hose-in-hose systems is that, here as well, an additional control is not always possible in practice as the user has no free hand left to operate an additional control.

Many of the above-mentioned disadvantages of hose-in-hose systems are remedied by replacing the control line by a power line. We refer to motorized hose reels whereby the winding signal is transmitted through conductors incorporated in the wall thickness of the hose (EP0953536). Between the housing and the drum of the hose reel is inserted a rotating wiper contact. It allows for a continuous electrical connection between the fixed part (housing) and the rotating part (drum) of the hose reel. Via said brush contact and a conductor in the hose is sent an electric current from the hose reel to a push button at the far end of the hose. By closing the push button, the electric current flows through another conductor back in the hose to the hose reel. This current is then converted into a winding signal.

A major disadvantage of this working method is the vulnerability of the conductors in the hose. While the hose is being wound and unwound, they are constantly bent, kinked and twisted. The constituent strands of the conductors break one by one until finally an electrical connection is no longer possible between the push button at one far end of the hose and the brush contact at the other far end of the hose. The result is that, especially in environments where hose reels are intensively used (e.g. car assembly plants), the hose has to be very often replaced. Moreover, this hose is especially developed for this particular type of hose reel and it is very expensive compared to a standard hose with the same dimensions. Moreover, replacing this special hose is a laborious operation.

The use of a push button at the far end of the hose creates numerous other disadvantages, especially in the ergonomic field. Given the location of the push button on the hose, the user must lift his tools to reach the push button with his free hand. This requires an extra effort. Especially with heavy tools this is most undesirable. An additional problem is that the push button is merely accessible on one side. Consequently, the user must often bend his wrist in all directions so as to be able to reach the push button. Finally, we mentioned the fact that in most assembly departments the users wear gloves. This makes operating the push button extra hard.

Finally, the fact remains here as well that this working method is only useful in work situations where the user has one hand free to operate the push button. In practice, this is not the case if the user needs one hand to carry his tool and the other hand to carry parts or other tools. Especially in assembly departments these situations are very common.

The present invention has succeeded in eliminating many disadvantages of existing motorized hose reels by introducing a method whereby the user can generate a winding signal immediately after use without having to operate an additional control. The present invention is distinct from existing motorized hose reels in particular in that the start signal for winding the hose is now generated via the already available control of a connected tool, a method which can be applied in combination with liquids (water, fuel, etc.) as well as gases (compressed air, nitrogen, etc.)

A tool, for example a pneumatic wrench, is appropriately connected to the free end of the hose. This tool is provided with a control that the user can operate by a single movement of his finger. When pinching the control, compressed air will flow through the tool and the wrench will start to turn. When the control is released, the compressed air supply is cut off and the wrench will stop turning.

In the invention as described in detail below, the hose is preferably connected to a motorized hose reel by means of a rotating coupling. This hose reel is in turn appropriately connected to an existing compressed air network via a supply line. Along this supply line is included a detection module, preferably inside the housing of the hose reel. This detection module mainly consists of a detection body through which the connected medium can flow, a signal sensor and a programmable processing unit. Depending on the application, we distinguish two principles: detection with movable components and detection without movable components.

In a detection module with movable components, the detection body is included in the supply line. With this type of detection module, a movable plunger is provided in the detection body. This may also be a ball, valve, paddle wheel or another obstruction component. Behind this plunger is situated a spring which makes sure that the plunger is pushed back into its starting position when there is not any flow of the medium. The spring force is selected such that the plunger moves at the slightest flow of the medium. The signal sensor is preferably provided with a make contact or breaker contact and is situated on the outside of the detection body. This may be a reed contact, but also a micro switch, an inductive sensor, an optical sensor, etc. This signal sensor reacts to any movement of the plunger by opening the breaker contact or closing the make contact. Every electrical signal coming from the signal sensor is subsequently transmitted to the processing unit.

Figure 6:
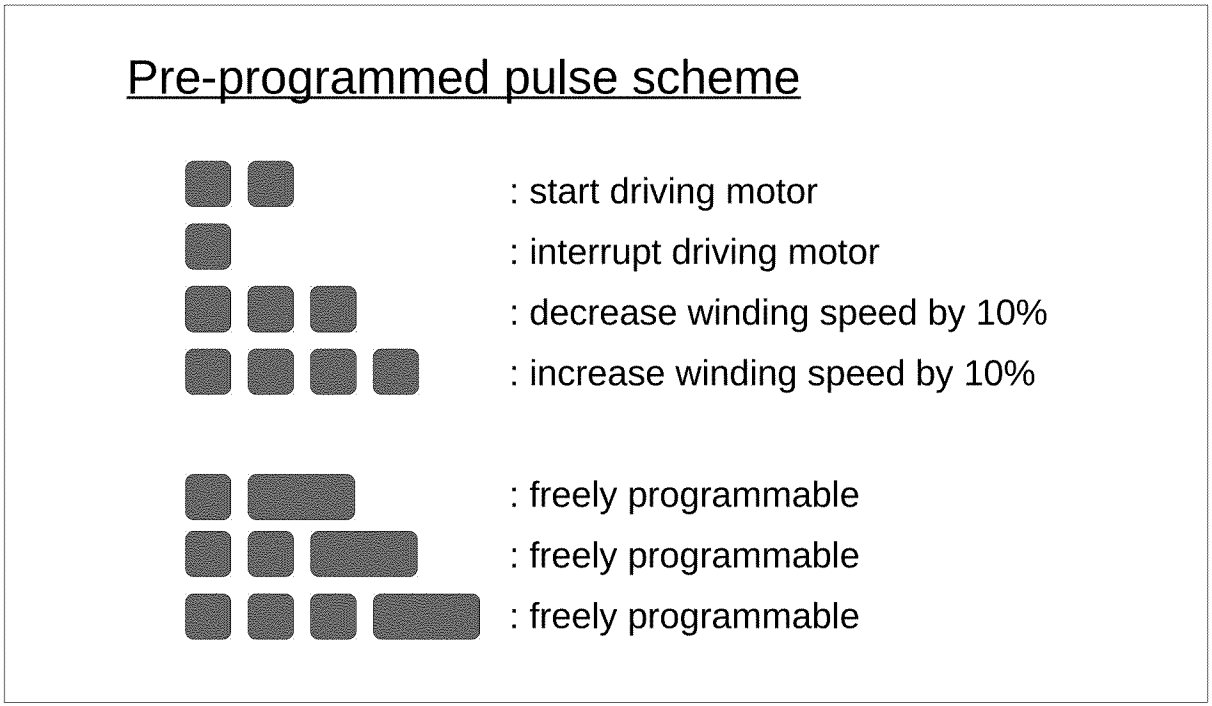

The detection module with movable components works as follows: each time the user pinches the control of the connected air tool, compressed air will flow through the supply line, shaft, rotating coupling and hose to the air tool. This flow pushes against the plunger in the detection body and moves it. The movement of the plunger is detected by the signal sensor, as a result of which the make contact closes and an electrical signal is sent to the processing unit. As soon as the user releases the control of the connected tool, the flow of compressed air stops. Due to the cessation of the flow, the spring in the detection body pushes the plunger back into its starting position, as a result of which the make contact of the signal sensor opens again and the electrical signal to the processing unit is interrupted. This means that prolonged take-ups of compressed air result in long signals, and short take-ups of compressed air result in short signals (pulses). The processing unit has been programmed such that long signals are ignored. Short signals (pulses), however, are read by the processing unit by means of a pulse scheme. Said pulse scheme is a register of possible functions whereby every function is linked to a particular pulse sequence, determined by the number of pulses and the length (time) of the pulses, and thus serves as a communication protocol. An example of a pre-programmed pulse scheme is shown in FIG. 6. On the basis of the received pulse signals, the processing unit will look in the pulse scheme for the corresponding pulse sequence. In fact, the processing unit compares the signal sequence coming from the signal sensor with the pre-programmed pulse sequences in the pulse scheme and, if they correspond, it will subsequently activate the required function. In most cases, this will be starting or stopping the motorized reel, but by extension it can also be used for other functions such as adjusting the winding speed, operating an electric valve or mixing valve, activating a dosing system (e.g. detergent), generating a sound signal, etc. The pulse scheme is pre-programmed, but it can be adapted or even expanded by the user. The detection module preferably provides the possibility to create a delay between the start signal for winding the hose and the actual activation of the motor.

In most cases, a cheaper detection module with movable components will suffice. However, in applications where the flow rate is of major importance, a detection module without any movable components should be used. This is the case for example for compressed air tools with calibrated torque control. Indeed, a detection module without any movable components is advantageous in that the flow of the medium is not hindered in any way by some obstruction in the line.

The working of a detection module without any movable components is largely similar. The only major difference is that the latter can be provided in, against or around a supply line since the supply line can actually function as a detection body. In this case, the signal sensor may be a capacitive sensor, ultrasonic sensor, mass sensor, thermal sensor, etc.

When using for example a capacitive sensor as a signal sensor, an electromagnetic field is generated in the line. As long as this field remains stable, nothing happens. As soon as the user pinches the control of the connected tool, compressed air will flow through the detection module and the electromagnetic field will be disturbed. This disruption is detected by the signal sensor. As a result, the make contact switches and an electrical signal is sent to the processing unit. This electrical signal is processed further in the same way as with a detection module with movable components.

When using for example an ultrasonic sensor as a signal sensor, a sound signal with a high frequency is transmitted and reflected. As long as there is not any flow of compressed air, this situation remains unchanged and the make contact stays open. As soon as the user pinches the control of the connected tool, compressed air will flow through the detection module and the ultrasonic sound signal will be disturbed. This disruption is detected by the signal sensor. As a result, the make contact switches and an electrical signal is sent to the processing unit. This electrical signal is processed further in the same way as with a detection module with movable components.

Irrespective of the type of detection module, in both cases applies that by making use of a detection body, signal sensor and processing unit, the user can generate a winding signal by operating the available control of the air tool with one or several pulses. Thanks to this method, he cannot only control the driving motor of the hose reel from a distance, but also all other sorts of functions.

Further, the drum of the hose reel according to the present invention is provided with or can be provided with a certain amount of hose, and it is preferably driven by a motor by means of a transmission. Depending on the application and depending on the available driving means, it may be an electric, pneumatic or hydraulic motor.

With the motorized hose reel according to the present invention, the hose is preferably connected to a supply line in an appropriate manner via a rotating coupling. With the right sealing, liquids as well as gases can be conveyed without leaking from the stationary part (housing) to the rotating part (drum).

The desired amount of hose length is preferably unwound manually. The transmission ratio between the driving motor and the drum is selected such that manually unwinding the hose requires a minimal effort from the user. Since the drum always stays connected to the drive, the self-locking effect of the driving motor provides for a slight counterforce. In the present invention, this force is used to prevent the drum from spinning too long due its inertia when the user stops dragging the hose.

In order to start the motorized winding of the hose, the user only has to give one or several short pulses to the tool's control according to the present invention. The number of pulses and the length (time) of the pulses depends on the pre-programmed pulse scheme and can be adjusted by the user.

In order to interrupt the drive while the hose is being wound, the user only has to give one short pulse to the tool's control. Here also applies that the number and the length (time) of the pulses have been preset but can be adjusted afterwards by the operator.

In order to interrupt the drive in case the hose should get caught somewhere while being wound, the motorized hose reel according to the present invention is preferably equipped with a current detection. As soon as the current exceeds a preset value, the drive will stop immediately. This current value is preferably adjustable by means of a potentiometer as a function of the application and at what height the hose reel is mounted. This adjustable current detection is limited to prevent the motorized hose reel from being used as a hoist.

One of the main aims of each hose reel is to prevent the user from tripping over the hose. For that reason, it is important that the speed at which the hose is wound is adjustable as a function of the walking pace (work speed) of the user. In this way, each individual user can adjust the speed such that the hose coils in front of his feet, thus excluding the risk of a tripping accident. With the motorized hose reels according to the present invention, this is preferably done by giving a pre-programmed pulse sequence. A specific pulse sequence may correspond to an increase or decrease in the winding speed with, for example, 10% of the maximum speed. The winding speed of the hose can also be set by means of a potentiometer which is appropriately connected to the electronic controller board of the driving motor.

In order to make sure that the hose ends up between the flanges of the drum during the motorized winding, the hose preferably runs through a hose guide. The opening in this hose guide is provided with a plurality of guiding rollers to protect the hose from any friction and cuts during the winding and unwinding. The hose guide is positioned such that the motorized hose reel according to the present invention can be appropriately mounted to a wall (horizontally) or to a ceiling (vertically).

At the free end of the hose is provided an obstruction, preferably made of rubber. It can be moved over the entire length of the hose and it makes sure that not the entire hose is wound. The outer diameter of this obstruction is larger than the opening in the hose guide, such that it is stopped by the hose guide as soon as the required amount of hose has been wound.

The drive stops as soon as the entire hose has been wound. In the motorized hose reel according to the present invention, this is preferably achieved by means of the hose guide. The latter is hinge-mounted to the housing and is maintained in its rest position by means of a spring. As soon as the rubber obstruction hits the hose guide during the motorized winding of the hose, the hose guide will be dragged along by the obstruction. A switching device, preferably integrated in the housing of the hose reel, detects the movement of the hinged hose guide and makes sure that the drive of the drum stops immediately. When the drive stops, the hinged hose guide goes back into its rest position thanks to the spring.

The motorized hose reel according to the present invention is preferably equipped with a brake. When the hose has been wound completely and the drive has stopped, the brake makes sure that the tool can cling to the hose reel without any additional support.

In order to illustrate the characteristics of the present invention, the following detailed description is given by way of an example only and without being limitative in any way, starting from a hose reel driven by an electric motor and equipped with a detection module with movable components and a signal sensor with make contact.

FIG. 1: typical arrangement

Figure 2:
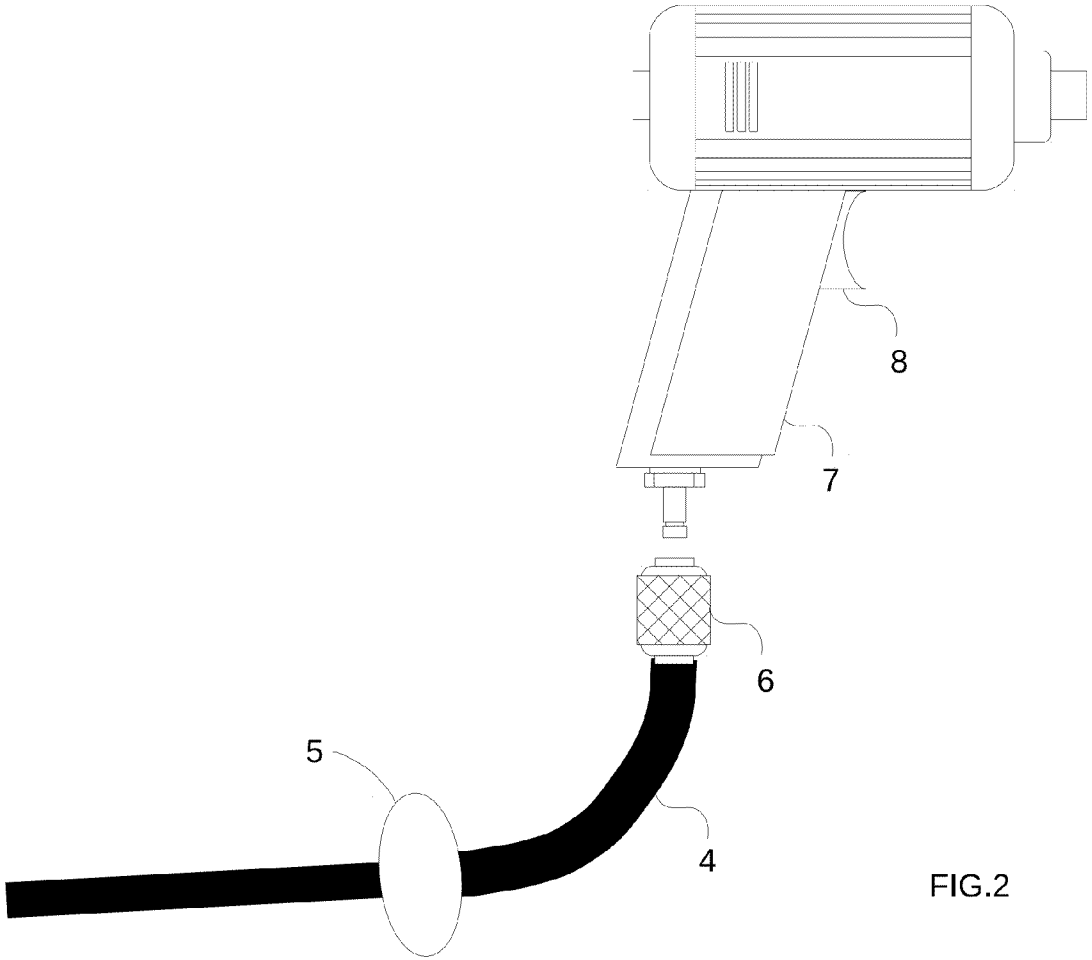

FIG. 2: detail of the free end of the hose with tool

Figure 3:
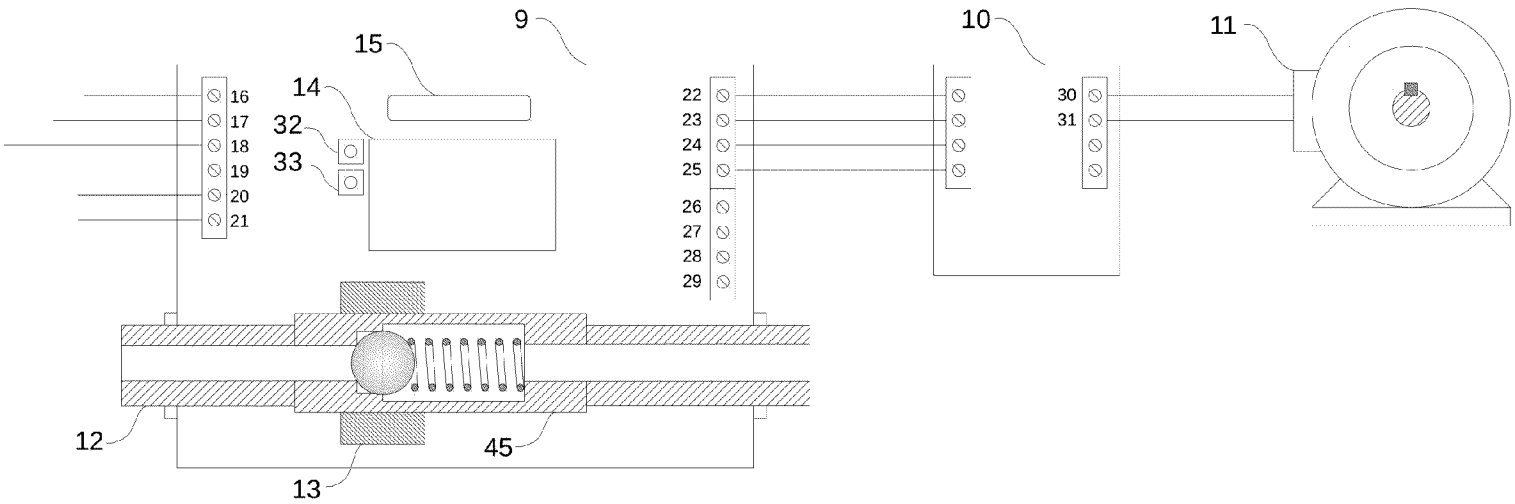
Figure 4:
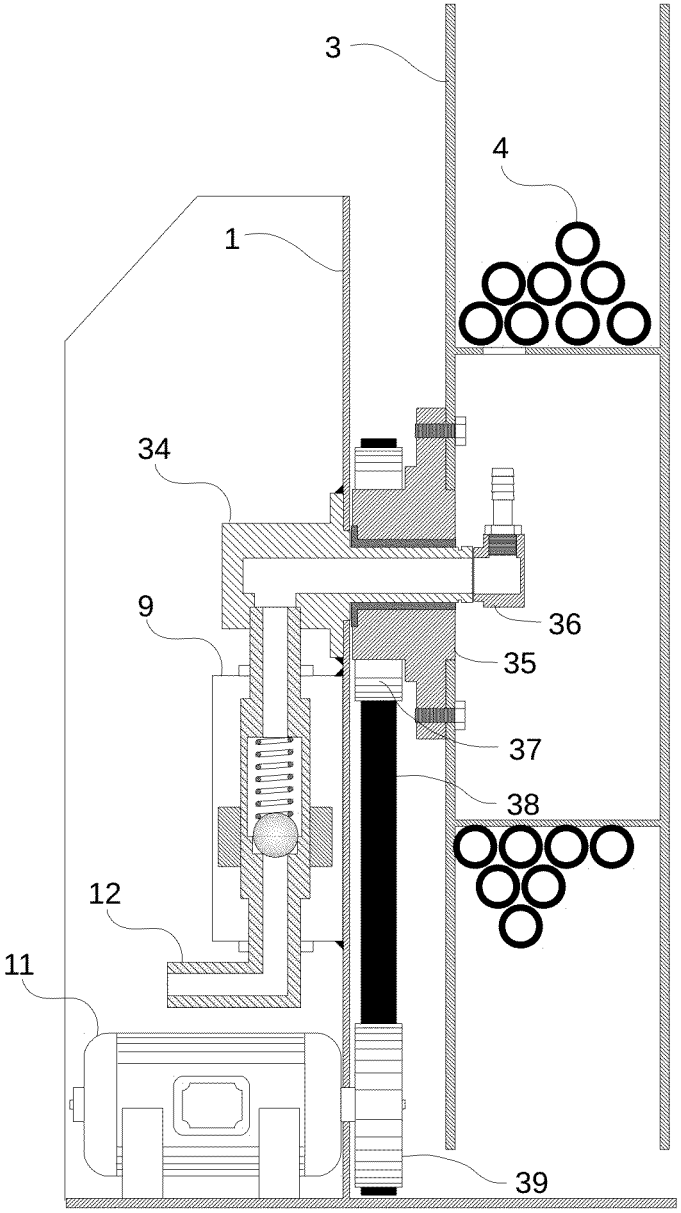
Figure 5:
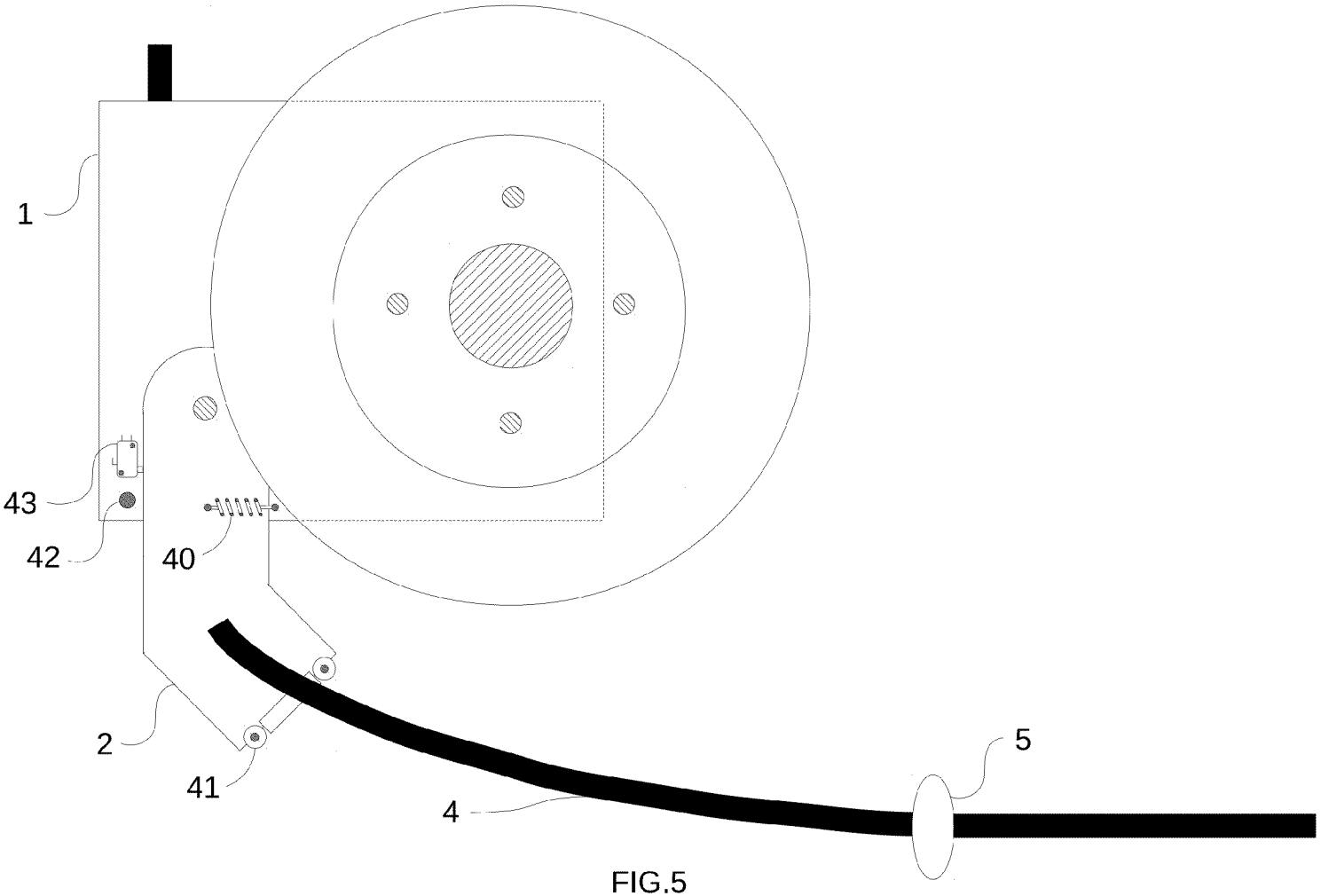
Figure 7:
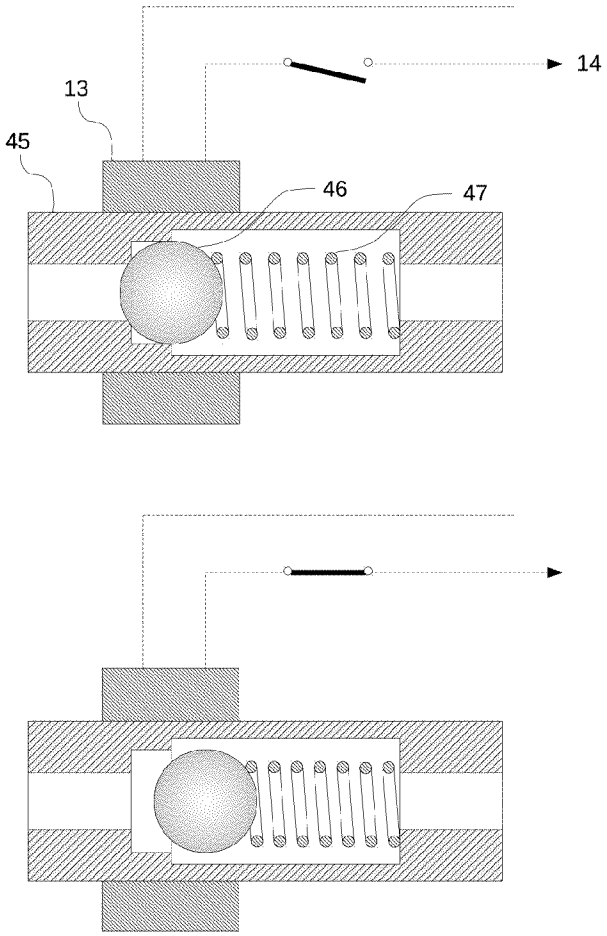

FIG. 3: representation of the connection between detection module, controller board, motor FIG. 4: representation of reel section FIG. 5: representation of hose guide FIG. 6: example of a pre-programmed pulse scheme FIG. 7: representation of detection body with movable components and make contact FIG. 1 shows a typical wall mounting of the motorized hose reel according to the present invention, consisting of a housing 1, a hinged hose guide 2 and a drum 3 on which a certain amount of hose 4 is wound. The hose reel is appropriately connected to an existing branching point by means of a supply line 12, for example, a compressed air network.

As shown in FIG. 2, a movable obstruction 5 and a connection 6 are situated at the free end of the hose 4 with which a tool 7, for example a pneumatic wrench with a control 8, can be appropriately connected to the hose 4.

FIG. 3 shows the relationship between the detection module 9, controller board 10 and driving motor 11. The detection module 9 is preferably integrated in the supply line 12 of the hose reel and mainly consists of a detection body 45 (see detail in FIG. 7), a signal sensor 13 and a processing unit 14. A connector 15 is provided to adapt the functionality of the detection module 9 later or to expand it, depending on the demands of the user. Terminals 16, 17 and 18 are connected to the power supply, whereas terminals 22 and 23 are designed to feed the controller board 10. Starting/stopping the drive and adjusting the winding speed is done by means of terminals 24 and 25 respectively. The other terminals 26-29 are additional outputs which may possibly be used for other functions, for example for opening or closing an electrically controlled valve in the supply line. The terminals 30 and 31 on the electronic controller board 10 are designed to feed the driving motor 11. The winding speed is preferably adjusted by means of a potentiometer, which is connected to terminals 20 and 21. Finally, a potentiometer 32 is provided on the detection module 9 to possibly set a delay between for example the winding signal and the actual activation of the driving motor, and a second potentiometer 33 is provided to adjust the current protection.

FIG. 4 shows a cross section of the motorized hose reel according to the present invention. The housing 1 is the supporting structure on which all other components are appropriately welded or screwed. A medium, for example compressed air, enters the hose reel via the supply line 12 to subsequently form, via the detection module 9, the hollow shaft 34 and the rotating coupling 36, a leak-proof connection with the hose 4. The drum 3 is connected to a bearing 35 so that it can rotate freely over the hollow shaft 34. The drum 3 is preferably driven by a toothed-belt wheel 37 on the bearing 35 and a toothed-belt wheel 39 on the output shaft of the driving motor 11. Both toothed-belt wheels are connected by means of a toothed belt 38.

FIG. 5 shows the hose guide 2 which is hinge-mounted to the housing 1. A spring 40 makes sure that the hose guide turns back into its rest position. On the other side of the hose guide is provided an opening where the hose 4 runs through. This opening is provided with a plurality of guiding rollers 41 to protect the sheath of the hose and to stop the rubber obstruction 5 as soon as the hose has been wound. A stop 42 on the housing makes sure that the hose guide 2 is checked as soon as the rubber obstruction 5 hits the hose guide. In its extreme position, the hose guide makes contact with a switching device 43 as a result of which the drive stalls.

FIG. 6 shows an example of a pulse scheme with pre-programmed pulse sequence. Naturally, the number of pulses and the length (time) of the pulses allow for many combinations. The same goes for the possible functions. A few typical examples are:

starting the driving motor
interrupting the driving motor
increasing or decreasing the speed of the driving motor
opening or closing the electric valve
starting or stopping the dosing system FIG. 7 shows a cross section of the detection body 45 with movable components and make contact. In the detection body 45 is provided a movable plunger 46, which is checked by a spring 47. On the outside of the detection body is situated a signal sensor 13 which is electrically connected to the processing unit 14. As soon as compressed air—or another medium—flows through the detection body 45 (bottom diagram) the plunger 46 will move and the signal sensor 13 will detect this movement, close a make contact and in this way transmit an electrical signal to the processing unit 14. When the flow stops (top diagram), the spring 47 will push the plunger 46 back into its starting position, the make contact of the signal sensor 13 will open again and the electrical signal to the processing unit 14 will be interrupted.

The above-mentioned description, including the accompanying drawings, is not meant to be restrictive in any way. The final embodiment of the hose reel according to the present invention may deviate while still remaining within the scope of what may be regarded as the essence of the present invention.

The invention claimed is:

1. A hose reel comprising:

a housing;

a length of hose through which a pressurized fluid medium can flow, the hose having a near end connectable to a pressurized fluid medium source, and a far end connectable to a fluid power tool;

a drum pivotally connected to the housing and rotatable about a central axis, the drum having a spool shaped periphery for supporting the length of hose when wound thereabout;

a motor mounted to the housing, the motor having a rotary output connected to the drum to rotatably drive the drum causing the hose to retract;

a rotating coupling having a fixed portion having an input connectable to a pressurized fluid medium source, and a rotatable portion having an outlet connected to the near end of the length of hose;

a sensor for detecting the flow of the fluid medium through the length of hose, the sensor generating a sensor signal responsive to fluid flow;

a detector receiving the sensor signal and generating an electrical pulse output indicative of fluid flow through the hose; and a programmable processing unit receiving the electrical pulse output of the detector, and generating a motor control signal which can start the motor, wherein the programmable processor is programmed to:

store a pre-programmed pulse scheme having a plurality of spaced apart pluses over a period of time;

monitor the electrical pulse output of the detector, and automatically generate a motor control signal to start the motor when the electrical pulse output of the detector matches the stored pre-programmed pulse scheme.

2. The hose reel of claim 1 further comprising:

a motor controller which receives the motor control signal from the processing unit, the motor controller having an electric power input and generating an electric power output which powers the motor.

3. The hose reel of claim 2 further comprising a motor speed input connected to the motor controller to enable an operator to vary the speed of the motor and the hose winding speed.

4. The hose reel of claim 2 wherein the motor controller includes a current detector which interrupts the power to the motor when the motor current exceeds a preset value.

5. The hose reel of claim 2 further comprising a brake cooperating with the housing and the drum to fix the drum when the hose is retracted and the tool is not in use.

6. The hose reel of claim 2 further comprising a ball type check valve which is fixed relative to the rotating coupling fixed portion, wherein the sensor in mounted adjacent the ball type check valve to sense the position of the ball and provide the signal which varies with fluid flow.

7. A method of retracting and rewinding a length of hose through which a pressurized fluid medium can flow about a hose reel, the hose having a near end connectable to a pressurized fluid medium source, and a far end connectable to a fluid powered power tool; the method comprising:

providing a motor driven drum pivotally connected to the housing and rotatable about a central axis by the motor, the drum having a spool shaped periphery for supporting the length of hose when wound thereabout;

providing a rotating coupling having a fixed portion having an input connectable to a pressurized fluid medium source, and a rotatable portion having an outlet connected to the near end of the length of hose;

generating a sensor signal responsive to the flow of the fluid medium through the length of hose and creating an electrical pulse output therefrom with a detector indicative of fluid flow through the hose;

storing in a programmable processing unit a pre-programmed pulse scheme having a plurality of spaced apart pulses over a period of time;

monitoring the electrical pulse output of the detector in the programmable processing unit;

generating motor control signal to start the motor when the electrical pulse output of the detector matches the stored pre-programmed pulse scheme, causing the motor connected to the drum to rotatably drive the drum to retract hose; and stopping the motor when the hose is retracted.

* * * * *